United States Patent [19]

Murphy et al.

[11] 4,312,082

[45] Jan. 26, 1982

[54] DISPENSING APPARATUS FOR TOILETS

[75] Inventors: John P. Murphy, New Orleans, La.; Jerry G. Kuderna, Modesto, Calif.

[73] Assignee: Shell Oil Company, Houston, Tex.

[21] Appl. No.: 164,480

[22] Filed: Jun. 30, 1980

[51] Int. Cl.[3] ..... E03D 9/02

[52] U.S. Cl. ..... 4/228; 4/227

[58] Field of Search ..... 4/227, 228, 223, 225

[56] References Cited

U.S. PATENT DOCUMENTS

| | | | |
|---|---|---|---|
| 2,761,151 | 9/1956 | Ferrando | 4/225 |
| 2,853,715 | 9/1958 | Ratcliffe | 4/225 |
| 3,060,457 | 10/1962 | Binni | 4/228 |
| 3,061,842 | 11/1962 | Woodruff | 4/225 |
| 3,084,350 | 4/1963 | Anderson | 4/225 |
| 3,254,797 | 6/1966 | Porter | 4/228 |
| 3,339,801 | 9/1967 | Hronas | 4/228 X |
| 3,890,657 | 6/1975 | Gray | 4/223 |
| 3,908,209 | 9/1975 | Fillmore | 4/228 |

*Primary Examiner*—Henry K. Artis

[57] ABSTRACT

An apparatus containable entirely within the tank of a toilet tank and bowl combination and adapted to dispense a predetermined amount of a liquid formulation into the toilet bowl in response to cycling of the water level in the tank during a flushing operation of the toilet. The apparatus comprises a reservoir for storage of a supply of the liquid formulation and a positive displacement dispensing pump which is driven through its working stroke by a float vertically movable in response to the cycling water level in the tank, said float having an open top and sealed bottom and peripheral sidewall defining a vertically extending interior cavity which nests the reservoir.

4 Claims, 9 Drawing Figures

DISPENSING APPARATUS FOR TOILETS

BACKGROUND OF THE INVENTION

This invention relates to an improvement in devices for use in the dispensing of predetermined quantities of liquid formulations into the toilet bowl of a toilet tank and bowl combination at the conclusion of each toilet flush cycle.

It is now possible, through the periodic dispensing of known chemical formulations into the water in a toilet bowl, to essentially eliminate the unpleasantries associated with the cleaning, deodorizing and disinfecting of the bowl. To facilitate the application of liquid chemicals to this end, the prior art relevant to the present invention provides a number of different devices which are adapted to function automatically, in cooperation with the flushing cycle of a toilet, to dispense a predetermined quantity of such a formulation into the fresh water fill in the toilet bowl at the conclusion of each flush cycle. Of the various types of these known devices, the dispensers of perhaps most significant practical utility, and of specific interest herein, are those which are containable entirely within the toilet tank of a toilet tank and bowl combination and which in general terms comprise (a) a reservoir for the storage of a supply of a desired liquid formulation, (b) a pump of the positive displacement type (e.g., a piston or diaphragm pump) having a pumping element reciprocally movable through a pump chamber, valved inlet means in liquid receiving communication with the reservoir, and outlet means adapted for liquid delivering communication with the toilet bowl, (c) a float vertically movable in response to the cycling of the water level in the tank during a toilet flush cycle, and (d) coupling means between the pump and the float or between the pump and the reservoir for transmitting the relative vertical movement of the float and the reservoir to the pump thereby reciprocally displacing the pumping element in its working stroke direction through the pump chamber. Illustration of dispensing devices of this sort is provided by U.S. Pat. No. 3,254,797 and U.S. Pat. No. 3,890,657. Descriptions of related devices may be found in U.S. Pat. Nos. 2,761,151, 3,060,457, 3,084,350 and 3,913,151.

With regard to all such dispensing devices intended for working containment within a toilet tank, it is recognized in the art that the physical size of a given device is critical to its successful operation and widespread consumer acceptance. A device of this nature should be suitable for use in toilet tanks having a broad range of design and mechanical features without interferring with their normal operation. Size and configuration of these dispersing devices are particularly critical for application to the modern low-silhouette and water-saver tanks.

Although there is recognition in the art of the advantages of compact devices, the float elements of known dispensers necessarily occupy a significant amount of space within the toilet tank, both with respect to the displacement volume occupied by the float in providing buoyant force and with respect to the space necessary to accommodate the vertical movement of the float during dispenser operation. Both the magnitude of the buoyant force and the length of the stroke provided by vertical movement of the coupled float contribute to assuring a positive driving force for operation of the dispensing pump. It is not possible to substantially reduce the size of floats of conventional design, whether sealed floats as illustrated in U.S. Pat. No. 3,913,151 or inverted cup-shaped floats as shown by U.S. Pat. Nos. 3,254,797 and 3,890,657, without adversely affecting dispenser performance.

It is the primary object of the present invention to provide dispensing devices of the sort herein described which are more spatially compact than conventional devices, and thus more suitable for application to their intended purpose, without adversely affecting dispensing performance.

SUMMARY OF THE INVENTION

In concise description of the invention it may be said that in a device containable entirely within the tank of a toilet tank and bowl combination and adapted to dispense a predetermined amount of a liquid formulation into the toilet bowl in response to cycling of the water level in the tank during a flushing operation of the toilet, said device comprising (a) a liquid reservoir for storage of a supply of the liquid formulation, said reservoir fixedly mountable within the toilet tank, (b) a positive displacement pump having a pumping element reciprocally movable through a pump chamber, valved inlet means in liquid receiving communication with the liquid reservoir, and outlet means in liquid delivering communication with the toilet bowl, (c) a float vertically movable in response to the cycling water level in the tank, and (d) coupling means between the pump and the float or between the pump and the reservoir for transmitting the relative vertical movement of the float and the reservoir to the pump and thereby reciprocally displacing the pumping element in its working stroke direction through the pump chamber, the invention is the improvement which comprises a cup-shaped float adapted to ride upright upon the cycling water level in the tank, said float having an open top and sealed bottom and peripheral sidewall defining a vertically extending interior cavity which nests the reservoir.

The recited function of the float in nesting the reservoir expresses the concept that the float cavity is of such a size and shape that the reservoir and, preferably also the pump, may be at least in part enclosed thereby. Preferably the reservoir and pump fit compactly into the float cavity.

When placed into actual operation in its intended functional environment of the toilet tank, a dispensing device having a float of such improved design provides a number of practical advantages over prior art devices. Most significantly, the float according to the invention provides the buoyant force necessary to drive the dispenser pump while occupying only a minimum of space within the toilet tank. In terms of toilet tank volume required for containment of the dispenser, the hollow interior of the improved float serves a dual, space-saving function by both providing the displacement necessary to float buoyancy and also spatially accommodating at least in part the reservoir of the complete dispenser. The volume of the tank space occupied by the improved float essentially coincides with that occupied by the reservoir, and preferably also the pump, and is not additive thereto as is the case with prior art devices. The invention also provides beneficial reduction of the overall linear dimension of the complete dispenser. The improved float does not contribute an independent component to this vertical dimension since, in contrast to the prior art, it is disposed toward rather than away from the other members of the device. Furthermore, the space-saving features of the improved float make possible a larger float than was practical for prior art devices. The greater buoyancy of a larger float provides greater instantaneous driving force for pump operation and enables a shorter effective working stroke of the coupled float and pumping element.

The invention provides further practical advantage over prior art devices by facilitating handling and packaging of the dispensers. The devices of the prior art, in which the float and pump/reservoir elements are spatially distinct and interconnected by an exposed coupling rod, are significantly more vulnerable to damage, for instance, breakage or misalignment, during handling and use than the improved devices of the invention which in certain embodiment provide double-walled construction and a shielded coupling. Other benefits realized through use of the improved dispensing devices of the invention will be noted when the invention is more particularly described with reference to the accompanying drawings. Still other advantages will be readily apparent to those skilled in the art.

BRIEF DESCRIPTION OF THE DRAWING

FIG. 3 is an enlargement of a portion of 2.

FIG. 7 depicts a sectional view.

DESCRIPTION OF THE PREFERRED EMBODIMENTS

The invention is now described with more particular reference to the attached drawings, which are intended to illustrate the features and operation of limited embodiments of the invention, but which are not intended to limit its broader scope. In the various figures, like numerals are used throughout to designate like parts.

Figure 1:
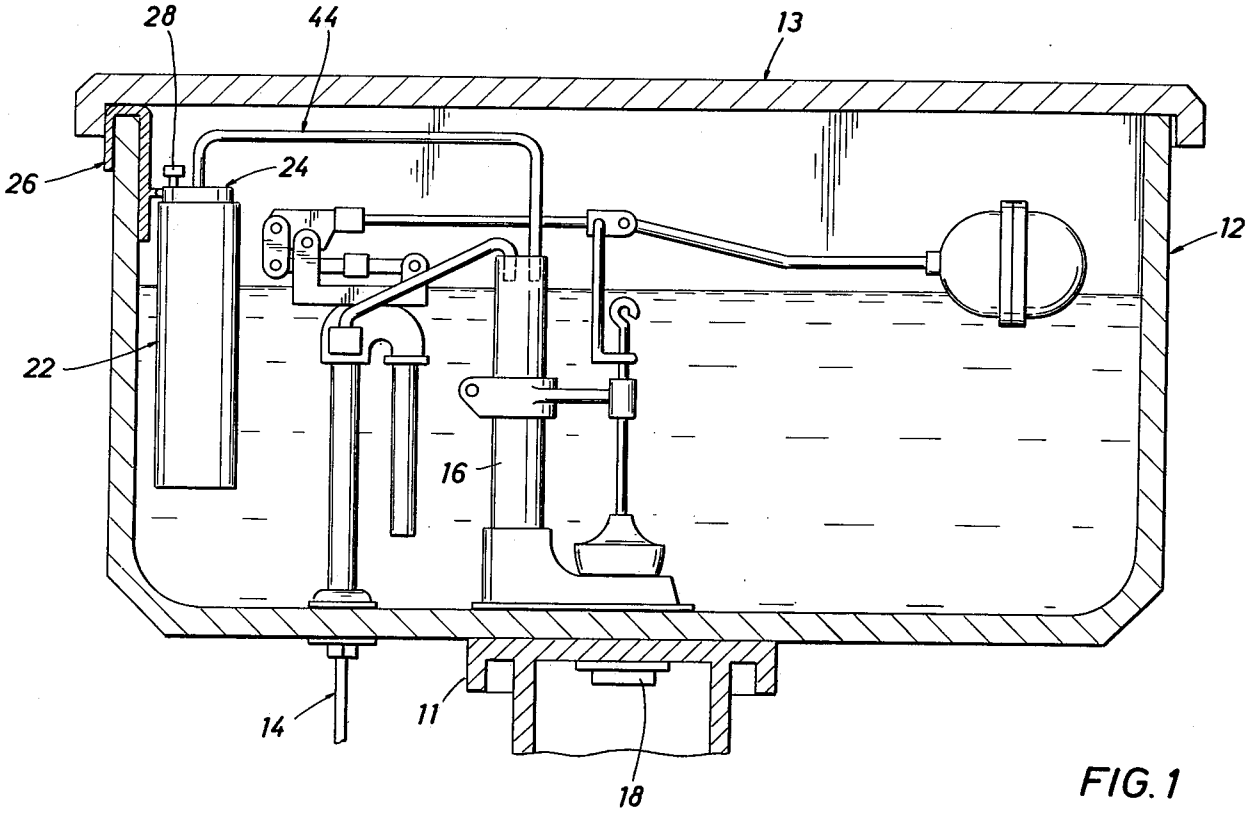
FIG. 1 is a fragmentary sectional view of a conventional toilet tank and bowl combination equipped with an improved dispensing device in accordance with the invention.

Attention is first directed to FIG. 1, illustrating a common conventional toilet tank equipped with a dispensing device in accordance with the invention. In addition to the invention, the visible parts of which are designated by the numerals 22, 24, 26, 28, and 44, this Figure generally depicts the tank 12 mounted upon an extension of the toilet bowl 11. Also shown, for the most part without numerical reference designations, are the widely recognized conventional mechanisms responsible for the automatic emptying and filling of the tank upon manual initiation of a flush cycle. A detailed description of such mechanisms is not necessary to an understanding of the invention. It is sufficient for present purposes to characterize the toilet tank mechanisms as providing a flush cycle comprising two phases: a first phase in which the water in the tank is released into the bowl (through interconnecting passage 18) and a second phase in which water (from an external supply via pipe 14) refills the tank.

Figure 4:
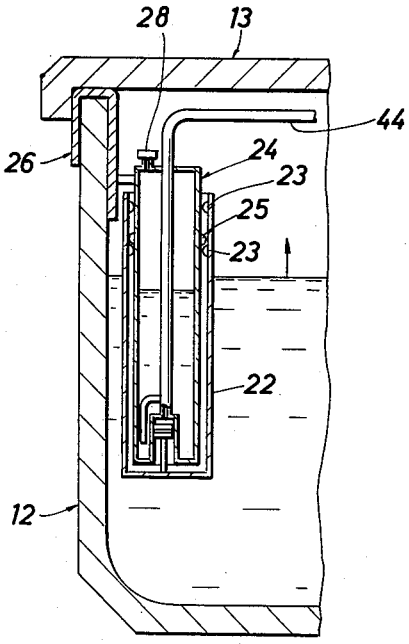
FIGS. 4 and 5 provide vertical sectional views of the same embodiment of the invention as that presented in FIGS. 1, 2, and 3 but illustrating a second condition of operation.
Figure 5:
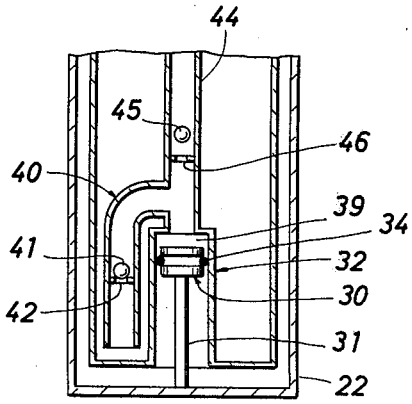
Figure 6:
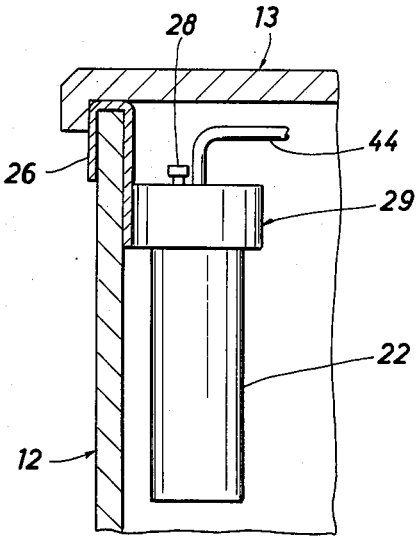
FIGS. 6 and 7 illustrate modifications to the embodiment of the invention shown in FIGS. 1 through 5. A full side view of this modification is given in FIG. 6.
Figure 7:
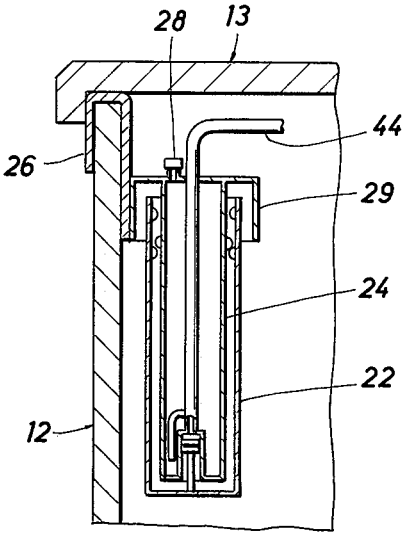
Figure 8:
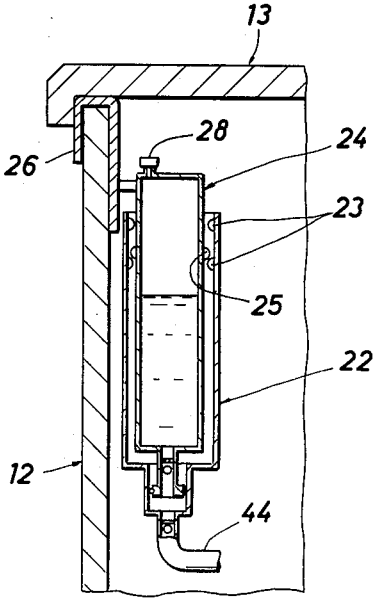
FIGS. 8 and 9 provide sectional views through the vertical axis of yet another embodiment of the invention.
Figure 9:
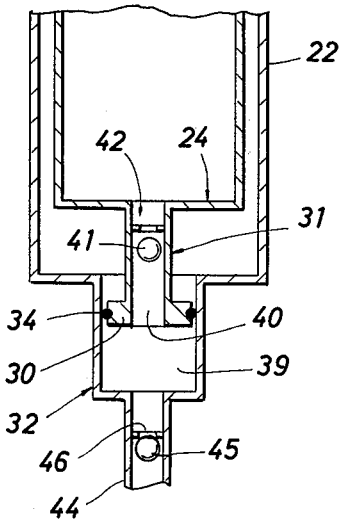

In the embodiment of the invention shown in FIGS. 1–5, as well as that shown in FIGS. 6 and 7 and also that in FIGS. 8 and 9, the reservoir element 24 is a vertically-extending cylindrical enclosure fixedly mounted within the tank by means of one or more mounting hangers 26, held between toilet tank wall 12 and tank lid 13. An opening 28 at or near the top of the reservoir provides venting during operation and, optionally, may also be used as a means of access for refilling of the reservoir with liquid formulation. In general, the reservoir and other parts of the apparatus of the invention can be constructed from any convenient material suitable for use in an aqueous environment; light-weight moldable plastics are preferred.

Figure 2:
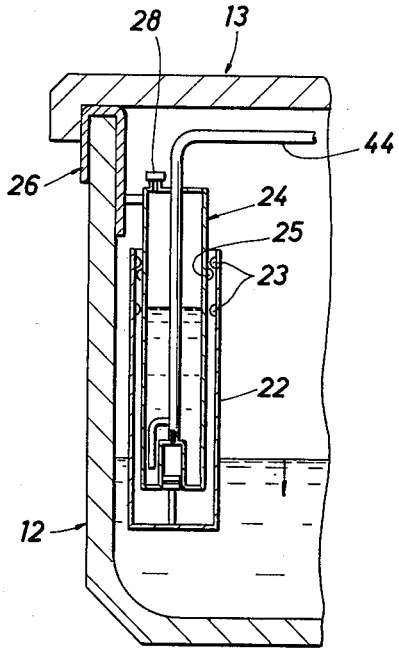
FIGS. 2 and 3 provide sectional views through the vertical axis of the embodiment of the invention of FIG. 1 in one condition of operation.
Figure 3:
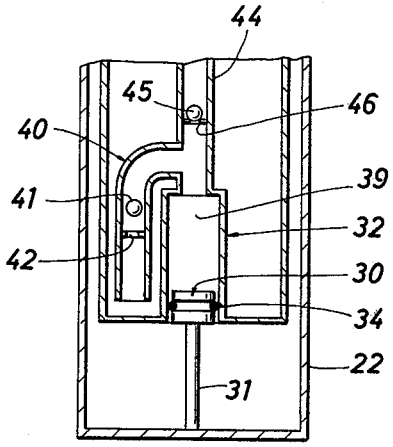

FIGS. 2 through 7 depict one type of positive displacement pump which is suitable for use in the improved apparatus of the invention. As shown, the pump is integrally formed into the bottom of cylindrical reservoir 24. FIGS. 3 and 5 illustrate in detail the cylindrical pump casing 32 which accommodates piston 30. The space bounded by the casing and the upper surface of the piston defines a working pump chamber 39 into which liquid formulation is drawn from the reservoir and discharged into the toilet bowl in response to a reciprocal stroke of the piston. A sealing means 34, suitably a ring of elastomeric material, is shown disposed between facing walls of the piston and casing to prevent leakage.

The pump chamber 39 is in liquid receiving communication with the reservoir via inlet means, here tube 40, shown equipped with valve ball 41 and seat 42. The valve arrangement shown, or its equivalent, permits flow of formulation from the reservoir to the pump chamber but effectively checks flow in the reverse direction. Pump outlet means, here tube 44, for directing discharge flow from the pump to the toilet bowl is also preferably equipped with a ball 45 and seat 46 or like valve means for checking reverse flow, although valving of the outlet means is not generally critical to operation of the invention. While it is important to good operation that there be little reverse flow through tube 44, this can be accomplished by care in the design of the inlet and outlet means of the device and in its vertical positioning in the tank, as well as by the use of valve means such as 45 and 46. As illustrated in FIG. 1, outlet means 44 may suitably discharge into the overflow standpipe 16, within the toilet tank. This standpipe, an essentially universal feature of toilet tank and bowl combinations, provides free fluid communication between the air space at the top of the tank and the bowl. Thus, delivery of liquid formulation to the standpipe accomplishes its delivery to the bowl. While they are less desirable, other modes of delivery, as are known in the art, are suitable for purposes of the invention.

As illustrated by each of FIGS. 1–7, the float 22 is formed with a vertically-extending cylindrical peripheral wall, positioned concentric with the reservoir wall, and with a closed bottom for buoyancy. Extending from the float bottom to the pump piston 30 and physically connected to each is rigid coupling rod 31. As shown, the hollow interior of the float compactly nests the reservoir 24 (as well as pump parts and coupling rod) without inhibiting axial motion of one relative to the other. While it is desirable that the reservoir and float walls be closely spaced in order to minimize dispenser size and also perhaps to utilize the concentric walls to assist in guiding and aligning reciprocal movement of the pump piston and the float, it is critical to successful operation of the invention that these walls be spaced sufficiently apart to permit a relatively free flow of air into and out of the float cavity and thus to prevent a vacuum or pressure lock between the reservoir and the float. In the apparatus illustrated, raised stops 23 and 25 are provided on the facing walls of the float and reservoir respectively to delimit travel of the float relative to the reservoir to a predetermined working range. Length of the pump piston stroke and therefore quantity of formulation delivered are fixed by the relative positioning of these stops. Suitable equivalent measures for limiting pump stroke, for instance, a stop built into the pump casing are known in the art.

It is known in the art that the float elements of conventional dispensing devices can be advantageously equipped with means, external to the float's working displacement volume, to entrap water which adds weight to the float and ensures positive downward stroke of the float and coupled pumping element. (See, for example, U.S. Pat. Nos. 3,890,657 and 3,254,797.) If desired, similar provision, not shown in the instant figures, may be made in the apparatus of the invention.

Placement of the apparatus according to the invention within the toilet tank must be such that both the dispensing device and the toilet tank flushing mechanisms have sufficient clearance to permit proper operation. Consideration must also be given in this regard to preventing the entry of tank water into the interior cavity of the float. For this purpose, it is obviously necessary that the apparatus be mounted such that the open top of the float is above the tank water level when the tank is filled to its normal capacity. More preferably, the dispenser is positioned so that the open top of the float is at a vertical elevation greater than that of the top of the overflow standpipe.

It is in certain instances of further concern to prevent the entry of water into the float cavity by indirect means such as, for instance, splashing during tank filling. FIGS. 6 and 7 illustrate one embodiment of the invention in which provision has been made to shield the open top of the float from indirect entry of water. An inverted cup-shaped cap 29, having a sealed top coinciding in part with the top of reservoir 24 and vertical cylindrical walls which skirt the top of the float walls, shields the open annular space between float and reservoir. The cylindrical cap walls are spaced radially away from those of the float so as to hinder neither its free vertical movement nor the free passage of air into and out of the float cavity.

For illustration of the operation of improved dispensing devices according to the invention, particular reference is now made to FIGS. 2 through 5, depicting two conditions of operation during the emptying and during the refilling of the toilet tank water, respectively. In FIGS. 2 and 3 after the initiation of a flush cycle, the water level in the tank drops permitting the float 22 to fall of its own weight, thereby pulling pump piston 30 downward relative to pump casing 32 and drawing formulation from the reservoir into the pump chamber 39 through open check valve elements 41 and 42. This downward motion of float and coupled piston continues until reservoir stop 25 contacts the upper of float stops 23, at which time pump chamber 39 is filled with a predetermined quantity of formulation.

FIGS. 4 and 5 illustrate operation of the dispensing device as the tank water is replenished. The rising water level in the tank drives the buoyant float 22 and coupled piston 30 upward relative to the stationary reservoir and pump casing. Movement of the piston 30 into pump chamber 39 displaces the formulation therein, through open valve elements 45 and 46, and delivery tube 44 to the toilet bowl.

Illustration is made in FIGS. 8 and 9 of yet another embodiment of the invention, one of simplified construction. With specific reference to FIG. 9, the dispenser pump shown in this detail is again of the piston type. Pumping chamber 39, here a spatial extension of the float cavity, is a cylindrical volume formed by casing 32 with walls depending from the bottom of float 22. Piston 30 is coupled to the bottom of reservoir 24 by means of the rigid walls of tube 31, the hollow interior of which serves as the liquid inlet means 40 for communication of reservoir fluid to the pump chamber. Flexible outlet means 44 for liquid discharge from the dispenser pump is also shown in part. As illustrated, outlet means 44 and inlet means 40 are each equipped with a check valve consisting of a valve seat, 46 and 42 respectively, and a floating valve ball, 45 and 41 respectively. A seal 34 on piston 30 separates the float cavity and the pump chamber, thereby providing a sealed bottom to the float as is necessary to its buoyancy.

In operation of the device of FIGS. 8 and 9, the piston pumping element is held stationary with respect to reservoir 24 by coupling means 31. Reciprocal working stroke of the pump piston 30 through chamber 39 is provided by vertical movement of the float 22, and thus the pump casing 32, with the cycling tank water level.

We claim as our invention:

1. A device, containable entirely within the tank of a toilet tank and bowl combination and adapted to dispense a predetermined amount of a liquid formulation into the toilet bowl in response to a cycling water level in the tank during a flushing operation of the toilet, which comprises (a) a liquid reservoir for storage of a supply of the liquid formulation, said reservoir fixedly mountable within the toilet tank, (b) a positive displacement pump having a pumping element reciprocally movable through a pump chamber, valved inlet means in liquid receiving communication with the liquid reservoir, and outlet means in liquid delivering communication with the toilet bowl, (c) a cup-shaped float adapted to ride upright upon the water level in the tank and to move vertically in response to the cycling of this water level, said float having an open top and sealed bottom and peripheral wall which define an interior cavity which nests the reservoir, and (d) coupling means between the pump and the float for transmitting the vertical motion of the float to the pump and thereby reciprocally displacing the pumping element in its working stroke direction through the pump chamber.

2. The dispensing device of claim 1, wherein the peripheral walls of the float and the nested reservoir are substantially cylindrical and concentric.

3. The device of claim 1 further comprising a cap which skirts the open top of the float.

4. The dispensing device of claim 1, wherein the positive displacement pump is of the piston type.

* * * * *